US006525004B1

(12) United States Patent
Hartley et al.

(10) Patent No.: US 6,525,004 B1
(45) Date of Patent: Feb. 25, 2003

(54) COMBUSTION IMPROVING ADDITIVE FOR SMALL ENGINE LUBRICATING OILS

(75) Inventors: Rolfe J. Hartley, Cranbury, NJ (US); Salvatore Rea, Franklin Square, NY (US); William H. Stover, Sarnia (CA)

(73) Assignee: Infineum International Inc. (GB)

( * ) Notice: Subject to any disclaimer, the term of this patent is extended or adjusted under 35 U.S.C. 154(b) by 0 days.

(21) Appl. No.: 09/847,015

(22) Filed: May 1, 2001

(51) Int. Cl.[7] ..... C10M 143/06; C10M 159/12
(52) U.S. Cl. ..... 508/188; 508/591; 548/405
(58) Field of Search ..... 508/188, 591; 548/405

(56) References Cited

U.S. PATENT DOCUMENTS

| | | | | | |
|---|---|---|---|---|---|
| 2,278,445 | A | | 4/1942 | Hull | 196/10 |
| 2,301,052 | A | | 11/1942 | Kirn et al. | 196/10 |
| 2,318,719 | A | | 5/1943 | Schneider et al. | 196/10 |
| 2,329,714 | A | | 9/1943 | Grasshof | 196/10 |
| 2,345,574 | A | | 4/1944 | Burk | 260/683.15 |
| 2,422,443 | A | | 6/1947 | Smith | 196/78 |
| 3,275,554 | A | | 9/1966 | Wagenaar | 252/50 |
| 3,442,808 | A | | 5/1969 | Traise et al. | 252/49.6 |
| 3,565,804 | A | | 2/1971 | Honnen et al. | 252/50 |
| 5,198,133 | A | * | 3/1993 | Papay | 508/188 |
| 5,225,092 | A | | 7/1993 | Emert et al. | 252/50 |
| 5,387,346 | A | * | 2/1995 | Hartley et al. | 508/188 |
| 5,439,606 | A | * | 8/1995 | Papay | 508/188 |
| 5,464,549 | A | | 11/1995 | Sieberth | 252/51.5 A |
| 5,487,838 | A | * | 1/1996 | Luciani et al. | 508/188 |
| 5,578,236 | A | * | 11/1996 | Srinivasan et al. | 508/188 |
| 5,624,890 | A | * | 4/1997 | Kagaya et al. | 508/561 |
| 5,811,377 | A | * | 9/1998 | Watts et al. | 508/188 |
| 5,888,948 | A | * | 3/1999 | Meny et al. | 508/591 |
| 5,965,498 | A | * | 10/1999 | Smythe | 508/468 |
| 5,972,851 | A | * | 10/1999 | Srinivasan et al. | 508/188 |
| 6,300,290 | B1 | * | 10/2001 | L'Heureux et al. | 508/287 |
| 6,352,962 | B1 | * | 3/2002 | Hata et al. | 508/188 |

* cited by examiner

*Primary Examiner*—Ellen M. McAvoy

(57) ABSTRACT

There are disclosed novel reaction products of a borated hydrocarbyl succinimide dispersant and a phosphorus compound selected from the group consisting of (i) zinc dialkyldithiophosphates and (ii) amine salts of acid phosphates which are highly effective combustion improver additives for use in two-cycle and small engine four-cycle lubricating oils.

14 Claims, No Drawings

COMBUSTION IMPROVING ADDITIVE FOR SMALL ENGINE LUBRICATING OILS

This invention relates to novel combustion improver additives and to lubricant compositions containing such additives useful for lubricating small engines. More particularly the invention relates to two-cycle oil characterized in that it contains a combustion improver, and thereby provides an oil which exhibits reduced combustion chamber and piston deposits for gasoline fueled two-cycle engines, such as outboard motors, motorcycle engines, moped engines, snowmobile engines, lawn mower engines and the like. Two-stroke-cycle gasoline engines now range from small, less than 50 cc engines, to higher performance engines exceeding 500 cc, generally over a range of 50–3000 cc. The development of such high performance engines has created the need for new two-cycle oil standards and test procedures.

Two-cycle engines are lubricated by mixing the fuel and lubricant and allowing the mixed composition to pass through the engine or by injecting the lubricant into the engine cylinders or crankcases. Various types of two-cycle oils, compatible with fuel, have been described in the art. Typically, such oils contain a variety of additive components in order for the oil to pass industry standard tests to permit use in two-cycle engines.

This invention further relates to universal oils suitable for lubricating both two-cycle engines and small four-cycle engines, i.e., four-cycle engines of about 3–25 horsepower, which contain a novel combustion improver additive.

The present invention is based on the discovery that the reaction product of a borated nitrogen-containing lubricating oil dispersant and certain phosphorus compounds functions as a highly effective combustion improving additive for two-cycle or small four-cycle engine oils.

Accordingly, in one embodiment of this invention there has been discovered a two-cycle lubricating oil composition having a kinematic viscosity of at least 6.5 $mm^2/s$ (cSt) at 100° C. comprising an admixture of:

(a) 3 to 50% by weight of a polybutene polymer being a polybutene, polyisobutylene or a mixture of polybutenes and polyisobutylenes having a number average molecular weight of about 300 to 1500;

(b) 2 to 45% by weight of a normally liquid hydrocarbon solvent having a boiling point of up to 380° C.;

(c) 0.1 to 10% by weight of a combustion improving additive being the reaction product of (1) a borated nitrogen-containing lubricating oil dispersant, and (2) a phosphorus compound selected from the group consisting of (i) zinc dialkyldithiophosphates, (ii) acid phosphates of the formula $(RX)_2P(:X)XH$ where R is H or $C_3$–$C_{20}$ hydrocarbyl, at least one R being hydrocarbyl, and X may be O or S, (iii) amine salts of the acid phosphates of (ii) wherein the amine is a primary or secondary $C_3$–$C_{20}$ aliphatic or aromatic amine, and (iv) phosphites of the formula $P(OX')_3$ wherein X' is H or hydrocarbyl, at least one X' being a hydrocarbyl, the hydrocarbyl being a $C_1$–$C_{20}$ aliphatic, aromatic or alkyl aromatic hydrocarbyl group.

(d) 20 to 94.9% by weight of a mineral or synthetic oil of lubricating viscosity; and (e) 0 to 20% by weight of an additive package for two-cycle lubricating oil additives, such additives being other than a polybutene polymer and being present in an amount to provide their normal attendant functions and to satisfy the industry standards for two cycle lubricating oil compositions.

All percentages are by weight on an active ingredient basis, based on the weight of the fully formulated lubricating oil composition.

The mixture of polybutenes preferably useful in the lubricating oil compositions of this invention is a mixture of poly-n-butenes and polyisobutylene which normally results from the polymerization of $C_4$ olefins and generally will have a number average molecular weight of about 300 to 1500 with a polyisobutylene or polybutene having a number average molecular weight of about 400 to 1300 being particularly preferred, most preferable is a mixture of polybutene and polyisobutylene having a number average molecular weight of about 950. Number average molecular weight (Mn) is measured by gel permeation chromatography. Polymers composed of 100% polyisobutylene or 100% poly-n-butene are also within the scope of this invention and within the meaning of the term "a polybutene polymer".

A preferred polybutene polymer is a mixture of polybutenes and polyisobutylene prepared from a $C_4$ olefin refinery stream containing about 6 wt. % to 50 wt. % isobutylene with the balance a mixture of 2-butene (cis- and trans-) 1-butene and less than 1 wt. % butadiene. Particularly, preferred is a polymer prepared from a $C_4$ stream composed of 6–45 wt. % isobutylene, 25–35 wt. % butanes and 15–50 wt. % 1- and 2-butenes. The polymer is prepared by Lewis acid catalysis.

The solvents useful in the present invention may generally be characterized as being normally liquid petroleum or synthetic hydrocarbon solvents having a boiling point not higher than about 380° C. at atmosphere pressure. Such a solvent must also have a flash point in the range of about 60–120° C. such that the flash point of the two-cycle oil of this invention is greater than 70° C. Typical examples include kerosene, hydrotreated kerosene, middle distillate fuels, isoparaffinic and naphthenic aliphatic hydrocarbon solvents, dimers, and higher oligomers of propylene, butenes and similar olefins as well as paraffinic and aromatic hydrocarbon solvents and mixtures thereof. Such solvents may contain functional groups other than carbon and hydrogen, provided such groups do not adversely affect performance of the two-cycle oil. Preferred is a naphthenic type hydrocarbon solvent having a boiling point range of about 91.1–113.9° C. sold as "Exxsol D80" by ExxonMobil Chemical Company. Preferably, there will be employed 5–40%, more preferably 10–40%, by weight of the solvent or a mixture of solvents in the two cycle oils of this invention.

The third component of the two-cycle oil of this invention is a combustion improver additive which may be present in an amount of 0.1 to 10 wt. %, preferably 0.5 to 2.5 wt. %, more preferably in an amount of 0.75 to 2.0 wt. %.

The combustion improver additive is the reaction product of a borated nitrogen-containing lubricating oil dispersant containing about 0.1 to 5.0 wt. % boron with certain oil soluble phosphorus compounds.

The nitrogen-containing lubricating oil dispersant comprises an oil soluble polymeric hydrocarbon backbone having functional groups that are capable of associating with particles to be dispersed. Typically, the dispersants comprise amine, or amide, moieties attached to the polymer backbone often via a bridging group. The dispersant may be, for example, selected from oil soluble salts, amino-esters, amides, imides, and oxazolines of long chain hydrocarbon substituted mono and dicarboxylic acids or their anhydrides; long chain aliphatic hydrocarbons having a polyamine attached directly thereto; and Mannich condensation products formed by condensing a long chain substituted phenol with formaldehyde and polyalkylene polyamine, and Koch reaction products.

The oil soluble polymeric hydrocarbon backbone is typically an olefin polymer, especially polymers comprising a major molar amount (i.e. greater than 50 mole %) of a $C_2$ to $C_{18}$ olefin (e.g., ethylene, propylene, butylene, isobutylene, pentene, octene-1, styrene), and typically a $C_2$ to $C_5$ olefin. The oil soluble polymeric hydrocarbon backbone may be a homopolymer (e.g., polypropylene or polyisobutylene) or a copolymer of two or more of such olefins (e.g., copolymers of ethylene and an alpha-olefin such as propylene and butylene or copolymers of two different alpha-olefins). Other copolymers include those in which a minor molar amount of the copolymer monomers, e.g., 1 to 10 mole %, is an alpha, ω-diene, such as a $C_3$ to $C_{22}$ non-conjugated diolefin (e.g., a copolymer of isobutylene and butadiene, or a copolymer of ethylene, propylene and 1,4-hexadiene or 5-ethylidene-2-norbornene). Atactic propylene oligomer typically having $\overline{M}n$ of from 700 to 5000 may also be used as described in EP-A-490454, as well as heteropolymers such as polyepoxides.

One preferred class of olefin polymers is polybutenes and specifically polyisobutenes (PIB) or poly-n-butenes, such as may be prepared by polymerization of a $C_4$ refinery stream. Another preferred class of olefin polymers is ethylene alpha-olefin (EAO) copolymers or alpha-olefin homo- and copolymers such as may be prepared using the metallocene chemistry having in each case a high degree (e.g. >30%) of terminal vinylidene unsaturation.

The oil soluble polymeric hydrocarbon backbone will usually have number average molecular weight ($\overline{M}n$) within the range of from 300 to 20,000. The $\overline{M}n$ of the backbone is preferably within the range of 500 to 10,000, more preferably 700 to 5,000 where the use of the backbone is to prepare a component having the primary function of dispersancy. Hetero polymers such as polyepoxides are also usable to prepare components. Both relatively low molecular weight ($\overline{M}n$ 500 to 1500) and relatively high molecular weight ($\overline{M}n$ 1500 to 5,000 or greater) polymers are useful to make dispersants. Particularly useful olefin polymers for use in dispersants have $\overline{M}n$ with the range of from 900 to 3000. Where the component is also intended to have a viscosity modification effect it is desirable to use higher molecular weight, typically with $\overline{M}n$ of from 2,000 to 20,000, and if the component is intended to function primarily as a viscosity modifier then the molecular weight may be even higher with an $\overline{M}n$ of from 20,000 up to 500,000 or greater. The functionalized olefin polymers used to prepare dispersants preferably have approximately one terminal double bond per polymer chain.

The oil soluble polymeric hydrocarbon backbone may be functionalized to incorporate a functional group into the backbone of the polymer, or as one or more groups pendant from the polymer backbone. The functional group typically will be polar and contain one or more hetero atoms such as P, O, S, N or halogen. It can be attached to a saturated hydrocarbon part of the oil soluble polymeric hydrocarbon backbone via substitution reactions or to an olefinic portion via addition or cycloaddition reactions. Alternatively, the functional group can be incorporated into the polymer in conjunction with oxidation or cleavage of the polymer chain end (e.g., as in ozonolysis).

Useful functionalization reactions include: halogenation of the polymer allylic to the olefinic bond and subsequent reaction of the halogenated polymer with an ethylenically unsaturated functional compound (e.g., maleation where the polymer is reacted with maleic acid or anhydride); reaction of the polymer with an unsaturated functional compound by the "ene" reaction absent halogenation; reaction of the polymer with at least one phenol group (this permits derivatization in a Mannich base-type condensation); reaction of the polymer at a point of unsaturation with carbon monoxide using a hydroformylation catalyst or a Koch-type reaction to introduce a carbonyl group attached to a —$CH_2$— or in an iso or neo position; reaction of the polymer with the functionalizing compound by free radical addition using a free radical catalyst; reaction with a thiocarboxylic acid derivative; and reaction of the polymer by air oxidation methods, epoxidation, chloroamination, or ozonolysis.

The functionalized oil soluble polymeric hydrocarbon backbone is then further derivatized with a nucleophilic reactant such as an amine, amino-alcohol, alcohol, metal compound or mixture thereof to form a corresponding derivative. Useful amine compounds for derivatizing functionalized polymers comprise at least one amine group and can comprise one or more additional amine or other reactive or polar groups. These amines may be hydrocarbyl amines or may be predominantly hydrocarbyl amines in which the hydrocarbyl group includes other groups, e.g., hydroxy groups, alkoxy groups, amide groups, nitriles, imidazoline groups, and the like. Particularly useful amine compounds include mono- and polyamines, e.g., polyalkylene and polyoxyalkylene polyamines of about 2 to 60, conveniently 2 to 40 (e.g., 3 to 20) total carbon atoms and about 1 to 12, conveniently 3 to 12, and preferably 3 to 9 nitrogen atoms in the molecule. Mixtures of amine compounds may advantageously be used, such as those prepared by reaction of alkylene dihalide with ammonia. Preferred amines are aliphatic saturated amines, including, e.g., 1,2-diaminoethane; 1,3-diaminopropane; 1,4-diaminobutane; 1,6-diaminohexane; polyethylene amines such as diethylene triamine; triethylene tetramine; tetraethylene pentamine; and polypropyleneamines such as 1,2-propylene diamine; and di-(1,3-propylene) triamine.

A preferred group of dispersants includes those substituted with succinic anhydride groups and reacted with polyethylene amines (e.g., tetraethylene pentamine), aminoalcohols such as trismethylolaminomethane, polymer products of metallocene catalyzed polymerizations, and optionally additional reactants such as alcohols and reactive metals. Also useful are dispersants wherein a polyamine is attached directly to the backbone by the methods shown in U.S. Pat. No. 5,225,092; and in U.S. Pat. No. 3,275,554 and U.S. Pat. No. 3,565,804 where a halogen group on a halogenated hydrocarbon is displaced with various alkylene polyamines.

Another class of dispersants comprises Mannich base condensation products. Generally, these are prepared by condensing about one mole of an alkyl-substituted mono- or polyhydroxy benzene with about 1 to 2.5 moles of carbonyl compounds (e.g., formaldehyde and paraformaldehyde) and about 0.5 to 2 moles polyalkylene polyamine as disclosed, for example, in U.S. Pat. No. 3,442,808. Such Mannich condensation products may include a polymer product of a metallocene catalyzed polymerization as a substituent on the benzene group or may be reacted with a compound containing such a polymer substituted on a succinic anhydride, in a manner similar to that shown in U.S. Pat. No. 3,442,808.

The borated dispersant is prepared by treating the nitrogen-containing dispersant with a boron compound selected from the group consisting of boron oxide, boron halides, boron acids and esters of boron acids or highly borated low $\overline{M}w$ dispersant, in an amount to provide a boron to nitrogen mole ratio of 0.01–3.0. Usefully the dispersants contain from about 0.1 to 5 wt. % boron based on the total weight of the borated dispersant. The boron, which appears in the product as dehydrated boric acid polymers (primarily $(HBO_2)_3$), is believed to be attached to the dispersant nitrogen atoms as amine salts e.g., a metaborate salt. Boration is readily carried out by adding from about 0.05 to 4, e.g., 1 to 3 wt. % (based on the weight of acyl nitrogen compound) of a boron compound, preferably boric acid, usually as a slurry, to the nitrogen-containing dispersant and heating with stirring at from 135° to 190° C., e.g., 140° to 170° C., for from 1 to 5 hours followed by nitrogen stripping. Alternatively, the boron treatment can be carried out by adding boric acid to a hot reaction mixture of the dicarboxylic acid material and amine while removing water. Additionally, other finishing steps such as those disclosed in U.S. Pat. No. 5,464,549, herein incorporated by reference, may be used.

Preferably, the combustion improver additive is prepared by reacting or complexing a borated hydrocarbyl succinimide lubricating oil dispersant wherein the hydrocarbyl has a $\overline{M}n$ of 300–3,000 with certain oil-soluble phosphorus compounds. Preferably the hydrocarbyl is a polyisobutenyl of $\overline{M}n$ 300–3,000, more preferably 450–2,500. These dispersants are well known in the art and are formed by reacting a hydrocarbyl, e.g. polyisobutenyl succinic anhydride with polyethylene amines such as tetraethylene pentamine or diethylene triamine.

To form the combustion improver additive the dispersant is reacted or complexed with certain oil-soluble phosphorus compounds by heating the reactants together at a temperature of 50° C. to 70° C. for a period of 15 to 60 minutes, preferably about 30 minutes. Formation of the stable complex or reaction product is indicated by no evidence of separation upon cooling to room temperature. The additives so produced are homogeneous, stable, clear liquids at room temperature. The mole ratio of boron to phosphorus compound may be 0.1:1 to 1.2:1, preferably 0.5:1 to 1:1. The exact mechanism of the formation of the reaction or complexed product is not completely understood.

Suitable phosphorus compounds for reaction with or complexing with the dispersant are selected from the group consisting of:

(i) oil soluble zinc dialkyldithiophosphates (ZDDP's) which are prepared by reacting $C_3$–$C_{12}$, preferably $C_4$–$C_8$, aliphatic alcohols with $P_2S5$ to produce dialkylthiophosphoric acids which are then reacted with zinc oxide to produce the ZDDP's;

(ii) acid phosphates of the formula $(RX)_2P(:X)XH$ where R is H or $C_3$–$C_{20}$ hydrocarbyl, at least one R being a hydrocarbyl, and X may be O or S, X is preferably O, the R hydrocarbyl is preferably a $C_3$–$C_{12}$ alkyl group;

(iii) amine salts of the acid phosphates of (ii) wherein the amine is a primary or secondary $C_3$–$C_{20}$ aliphatic or aromatic amine, preferably a primary or secondary $C_3$–$C_{16}$ alkyl amine; and (iv) phosphites of the formula $P(OX')_3$ wherein X' is H or hydrocarbyl, at least one X' being a hydrocarbyl, the hydrocarbyl being a $C_1$–$C_{20}$ aliphatic, such as alkyl or alkenyl, aromatic or alkyl aromatic hydrocarbyl group, X' is preferably a $C_1$–$C_3$ alkyl phenyl. Tricresyl phosphite is particularly preferred.

The aforesaid combustion improver additives are considered novel compositions of matter and as such constitute a further embodiment of this invention.

In addition to the two-cycle oils and universal small engine oils discussed herein, a still further embodiment of this invention comprises an oil of lubricating viscosity comprising an effective amount of the novel combustion improver additive of this invention, such effective amounts being from 0.1 to 10.0 wt. %, such as 0.5 to 2.5 wt. %.

The fourth component of the lubricating compositions of this invention is an oil of lubricating viscosity, that is, a viscosity of about 20–180, preferably 55–180 cSt at 40° C., to provide a finished two-cycle oil in the range of 6.5–14 cSt at 100° C.

These oils of lubricating viscosity for this invention can be natural or synthetic oils. Mixtures of such oils are also often useful. Blends of oils may also be used as long as the final viscosity is 20–180 cSt at 40° C.

Natural oils include mineral lubricating oils such as liquid petroleum oils and solvent-treated or acid-treated mineral lubricating oils of the paraffinic, naphthenic or mixed paraffinic-naphthenic types. Oils of lubricating viscosity derived from coal or shale are also useful base oils.

Synthetic lubricating oils include hydrocarbon oils such as esters, polymerized and interpolymerized olefins, alkylated diphenyl ethers and alkylated diphenyl sulfides and the derivatives, analogs and homologs thereof.

Oils made by polymerizing olefins of less than 5 carbon atoms and mixtures thereof are typical synthetic polymer oils. Methods of preparing such polymer oils are well known to those skilled in the art as is shown by U.S. Pat. Nos. 2,278,445; 2,301,052; 2,318,719; 2,329,714; 2,345,574; and 2,422,443.

Alkylene oxide polymers (i.e., homopolymers, interpolymers, and derivatives thereof where the terminal hydroxyl groups have been modified by esterification, etherification, etc.) constitute a preferred class of known synthetic lubricating oils for the purpose of this invention, especially for use in combination with alkanol fuels. They are exemplified by the oils prepared through polymerization of ethylene oxide or propylene oxide, the alkyl and aryl ethers of these polyoxyalkylene polymers (e.g., methyl polypropylene glycol ether having an average molecular weight of 1000, diphenyl ether of polyethylene glycol having a molecular weight of 500–1000, diethyl ether of polypropylene glycol having a molecular weight of 1000–1500, etc.) or mono- and polycarboxylic esters thereof, for example, the acetic acid esters, mixed $C_3$–$C_8$ fatty acid esters, or the $C_{13}$ Oxo acid diester of tetraethylene glycol.

Another suitable class of synthetic lubricating oils comprises the esters of dicarboxylic acids (e.g., phthalic acid, succinic acid, alkyl succinic acids, alkenyl succinic acids, maleic acid, azelaic acid, suberic acid, sebacic acid, fumaric acid, adipic acid, linoleic acid dimer, malonic acid, alkyl malonic acids, alkenyl malonic acids, etc.) with a variety of alcohols (e.g., butyl alcohol, hexyl alcohol, octyl alcohol, dodecyl alcohol, tridecyl alcohol, 2-ethylhexyl alcohol, ethylene glycol, diethylene glycol monoether, propylene glycol, etc.). Specific examples of these esters include dioctyl adipate, di(2-ethylhexyl)sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethylhexanoic acid and the like.

Esters useful as synthetic oils also include those made from $C_5$ to $C_{18}$ monocarboxylic acids and polyols and polyol ethers such as neopentyl glycol, trimethylol propane, pentaerythritol, dipentaerythritol, tripentaerythritol, etc.

Unrefined, refined and rerefined oils, either natural or synthetic (as well as mixtures of two or more of any of these)

of the type disclosed hereinabove can be used in the lubricant compositions of the present invention. Unrefined oils are those obtained directly from a natural or synthetic source without further purification treatment. For example, a shale oil obtained directly from retorting operations, a petroleum oil obtained directly from primary distillation or an ester oil obtained directly from an esterification process and used without further treatment would be an unrefined oil. Refined oils are similar to the unrefined oils except they have been further treated in one or more purification steps to improve one or more properties. Many such purification techniques are known to those of skill in the art such as solvent extraction, secondary distillation, acid or base extraction, filtration, percolation, etc. Rerefined oils are obtained by processes similar to those used to obtain refined oils which have been already used in service. Such rerefined oils are also known as reclaimed or reprocessed oils and often are additionally processed by techniques directed to removal of spent additives and oil breakdown products.

The invention further comprises the presence of 0–20% by weight of an additive package which contains one or more conventional two-cycle lubricating oil additives, and these may be any additive normally included in such lubricating oils for a particular purpose. Preferably there is employed 0.5–15% by weight, more preferably 0.5–7.0% by weight of the additive package.

Such conventional additives for the additive package component which may be present in the composition of this invention include corrosion inhibitors, oxidation inhibitors, friction modifiers, dispersants, antifoaming agents, antiwear agents, pour point depressants, metal detergents, rust inhibitors, lubricity agents, which are preferred, and the like.

A preferred additive package for two-cycle engine oils for air cooled engines will comprise (i) borated polyisobutenyl ($\overline{M}$n 400–2500, preferably $\overline{M}$n 950) succinimide present in such amount to provide 0.2–5 wt. %, preferably 1–3 wt. % dispersant in the lubricating oil and (ii) a metal phenate, sulfonate or salicylate oil soluble detergent additive, which is a neutral metal detergent or overbased such that the Total Base Number is 200 or less, present in such amount so as to provide 0.1–2 wt. %, preferably 0.2–1 wt. % metal detergent additive in the lubricating oil. The metal is preferably sodium, calcium, barium or magnesium. Neutral calcium sulfurized phenates are preferred.

Corrosion inhibitors are present in amounts of 0.01–3 wt. %, preferably 0.01–1.5 wt. %, and are illustrated by phosphosulfurized hydrocarbons and the products obtained by reacting a phosphosulfurized hydrocarbon with an alkaline earth metal oxide or hydroxide. Another useful corrosion inhibitor is benzotriazole (35 wt. % active ingredient in propylene glycol).

Oxidation inhibitors are present in amounts of 0.01–5 wt. %, preferably 0.01–1.5 wt. % and are antioxidants exemplified by alkaline earth metal salts of alkylphenol thioesters having preferably $C_5$–$C_{12}$ alkyl side chain such as calcium nonylphenol sulfide, barium t-octylphenol sulfide, dioctylphenylamines as well as sulfurized or phosphosulfurized hydrocarbons and hindered phenols. Also included are oil soluble antioxidant copper compounds such as copper salts of $C_{10}$ to $C_{18}$ oil soluble fatty acids.

Friction modifiers are present in amounts of 0.01–3 wt. %, preferably 0.01–1.5 wt. %, and include fatty acid esters and amides, glycerol esters of dimerized fatty acids and succinate esters or metal salts thereof.

Pour point depressants, also known as lube oil flow improvers, are used in amounts of 0.01–2 wt. %, preferably 0.01–1.5 wt. %, and can lower the temperature at which the fluid will flow and typical of these additives are $C_8$–$C_{18}$ or $C_{14}$ dialkyl fumarate vinyl acetate copolymers, which are preferred, polymethacrylates and wax naphthalene.

Foam control can also be provided by an anti-foamant of the polysiloxane type such as silicone oil and polydimethyl siloxane; acrylate polymers are also suitable. These are used in amounts of 5 to 25 ppm in the finished oil.

Anti-wear agents reduce wear of metal parts and representative materials are zinc dialkyldithiophosphate, zinc diaryl diphosphate, and sulfurized isobutylene. These are used in amounts of 0.01–5 wt. %. But preferably, the two-cycle or universal oils of this invention will not contain the foregoing zinc dialkyldithiophosphate or zinc diaryl dithiophosphate anti-wear agents nor any other anti-wear agent since the combustion improver additive of this invention will also provide adequate anti-wear properties to the oils.

Lubricity agents useful in this invention may be selected from a wide variety of oil soluble materials. Generally, they are present in an amount of 1–20 wt. %, preferably about 5–15 wt. %. Lubricity agents include polyol ethers and polyol esters such as polyol esters of $C_5$–$C_{15}$ monocarboxylic acids, particularly pentaerythritol, trimethylol propane and neopentyl glycol synlube esters of such acids, wherein the ester has a viscosity of at least 9 $mm^2/s$ (cSt) at 100° C., natural oils such as bright stock which is the highly viscous mineral oil fraction derived from the distillation residues formed as a result of the preparation of lubricating oil fractions from petroleum.

A preferred lubricity agent is an a-olefin/dicarboxylic acid ester copolymer having a viscosity of 20 to 50 $mm^2/s$ (cSt) at 100° C., which is represented by the following general formula:

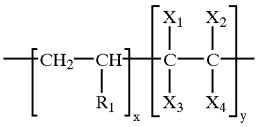

wherein $R_1$ is a straight-chain or branched alkyl group; $X_1$, $X_2$, $X_3$ and $X_4$ may be the same or different and are each hydrogen, a straight-chain or branched alkyl group, a group represented by the formula —$R_2$—$CO_2R_3$ or an ester group represented by the formula —$CO_2R_4$ wherein $R_2$ is a straight-chain or branched alkylene group, $R_3$ and $R_4$ may be the same or different and are each a straight-chain or branched alkyl group, any two of $X_1$, $X_2$, $X_3$ and $X_4$ are each said ester group; and x and y may be the same or different and are each a positive number.

The structure above represented by the formula

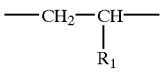

is derived from an (α-olefin, and the number of carbon atoms of the α-olefin is preferably 3 to 20, still preferably 6 to 18. Examples of the α-olefin include propylene, 1-butene, 1-pentene, 1-hexene, 1-heptene, 1-octene, 1-nonene, 1-decene, 1-undecene, 1-dodecene, 1-tridecene, 1-tetradecene, l-pentadecene, 1-hexadecene, 1-heptadecene, 1-octadecene, 1-nonadecene and l-eicosene.

The structure above represented by the formula

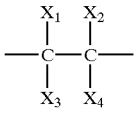

is derived from an ester of a dicarboxylic acid having ethylene linkage. Examples of the dicarboxylic acid include maleic acid, fumaric acid, citraconic acid, mesaconic acid, and itaconic acid. The alcohol is preferably one having 1 to 20 carbon atoms, still preferably one having 3 to 8 carbon atoms. Examples of the alcohol include methanol, ethanol, propanol, butanol (preferred), pentanol, hexanol, heptanol, octanol, nonanol, decanol, undecanol, dodecanol, tridecanol, tetradecanol, pentadecanol, hexadecanol, heptadecanol, octadecanol, nonadecanol and eicosanol. The component (A) is prepared by copolymerizing the above-described α-olefin with the above-described ester of a dicarboxylic acid. This process is described in detail in Japanese Patent Application Laid-Open Gazette No. (Sho.) 58-65246. The molar ratio of the α-olefin (x) to the ester (y) of a dicarboxylic acid is preferably x:y=1:9 to 9:1. The number average molecular weight of the ester copolymer is preferably 1000 to 3000. The kinematic viscosity should be 20 to 50 $mm_2/s$ (cSt) at 100° C., preferably 30 to 40 $mm_2/s$ (cSt) at 100° C. These materials are available under the trademark "Ketjenlube" from Akzo Chemicals, Inc.

Other suitable lubricity agents include phosphorus containing additives such as dihydrocarbyl hydrocarbyl phosphonates and sulfur containing lubricity agents such as sulfurized fats, sulfurized isobutylene, dialkyl polysulfides, and sulfur bridged phenols such as nonylphenol polysulfide.

Other suitable lubricity agents include fatty acids (including dimers and trimers thereof), fatty ethers, fatty esters and methoxylated fatty ethers and esters such as ethylene oxide/propylene oxide copolymers and fatty esters of these materials as well as natural materials such as vegetable oils, glycerides and the like. Still further suitable lubricity agents include borate esters such as tricresyl borate ester condensates and phosphorus containing esters such as tricresyl phosphate and other trialkyl and triaryl phosphites and phosphates. Other lubricity agents include orthophosphate or sulfate salts of primary or secondary aliphatic amines having 4 to 24 carbon atoms, dialkyl citrates having an average of from 3 to 12 carbon atoms in the alkyl groups, aliphatic dicarboxylic acids and esters thereof, chlorinated waxes and polyhaloaromatic compounds such as halogenated benzenes and naphthalenes.

The two-cycle lubricating oil compositions of the present invention will mix freely with the fuels used in such two-cycle engines. Admixtures of such lubricating oils with fuels comprise a further embodiment of this invention. The fuels useful in two-cycle engines are well known to those skilled in the art and usually contain a major portion of a normally liquid fuel such as a hydrocarbonaceous petroleum distillate fuel, e.g., motor gasoline is defined by ASTM specification D-439-73. Such fuels can also contain non-hydrocarbonaceous materials such as alcohols, ethers, organic nitro compounds and the like, e.g., methanol, ethanol, diethyl ether, methylethyl ether, nitromethane and such fuels are within the scope of this invention as are liquid fuels derived from vegetable and mineral sources such as corn, alpha shale and coal. Examples of such fuel mixtures are combinations of gasoline and ethanol, diesel fuel and ether, gasoline and nitromethane, etc. Gasoline is preferred, i.e., mixture of hydrocarbons having an ASTM boiling point of 60° C. at the 10% distillation point to about 205° C. at the 90% distillation point. Lead-free gasoline is particularly preferred.

The two-cycle lubricants of this invention are used in admixture with fuels in amounts of about 20 to 250 parts by weight of fuel per 1 part by weight of lubricating oil, more typically about 30–100 parts by weight of fuel per 1 part by weight of oil. They may also be used by directly injecting the lubricant into the cylinders or crankcases of a two-cycle engine.

The combustion engine improver additives of the invention are also effective for the preparation of lubricating oils effective for the lubrication of small four-cycle engines, i.e., engines of 3–25 horsepower (hp) (2.24–18.64 kW), preferably 4–6 hp (2.98–4.53 kW), or 100 to 200 cc engines, since the combustion improver additive will provide the necessary anti-wear properties to the four-cycle oil composition. Thus, it is possible in accordance with the present invention to formulate so-called universal oils, i.e., oils suitable for both two-cycle and small four-cycle engines. Such universal oils will have the same ingredients as the two cycle oils disclosed above, but will contain 2 to 15% by weight of solvent and will preferably be free of any anti-wear additives such as zinc-containing anti-wear additives (other than the combustion improving additives of this invention).

Accordingly, there has further been discovered a universal lubricating oil composition suitable for lubrication of two-cycle engines and small four-cycle engines of 3–25 horsepower (2.24–18.64 kW) having a kinematic viscosity of at least 6.5 $mm^2/s$ (CSt) at 100° C. comprising an admixture of:

(a) 3 to 50% by weight of a polybutene polymer being a polybutene, polyisobutylene or a mixture of polybutenes and polyisobutylenes having a number average molecular weight of about 300 to 1500;

(b) 2 to 15% by weight of a normally liquid hydrocarbon solvent having a boiling point of up to 380° C.;

(c) 0.1 to 10% by weight of a combustion improving additive being the reaction product of (1) a borated nitrogen-containing lubricating oil dispersant, and (2) a phosphorus compound selected from the group consisting of (i) zinc dialkyldithiophosphates, (ii) acid phosphates of the formula $(RX)_2P(:X)XH$ where R is H or $C_3$–$C_{20}$ hydrocarbyl, at least one R being hydrocarbyl, and X may be O or S, (iii) amine salts of the acid phosphates wherein the amine is a primary or secondary $C_3$–$C_{20}$ aliphatic or aromatic amine, and (iv) phosphites of the formula $P(OX')_3$ wherein X' is H or hydrocarbyl, at least one X' being a hydrocarbyl, the hydrocarbyl being a $C_1$–$C_{20}$ aliphatic, aromatic or alkyl aromatic hydrocarbyl group.

(d) 20 to 94.9% by weight of a mineral or synthetic oil of lubricating viscosity; and (e) 0 to 20% by weight of an additive package for two cycle lubricating oil additives, such additives being other than a polybutene polymer and being present in an amount to provide their normal attendant functions and to satisfy the industry standards for two cycle lubricating oil compositions.

Preferred universal oils will comprise a combustion improving additive being the reaction product of a zinc dialkyl dithiophosphate and the borated dispersant.

The invention is further illustrated by the following examples which are not to be considered as limitative of its scope. Percentages are by weight.

EXAMPLES

A two-cycle test oil was prepared composed of the following:

(a) 5.0% of a 50.5% mineral oil solution of a $\overline{M}n$ 950 polyisobutenyl succinimide dispersant;

(b) 5.0% of a 75% mineral oil solution of an $\overline{M}n$ 700 polyisobutenyl succinimide dispersant;

(c) 10.0% of $\overline{M}n$ 950 polyisobutylene;

(d) 25.0% of a naphthenic type hydrocarbon solvent b.p. range 91.1 –11 3.9° C., sold as "Exxol D80" by ExxonMobil Chemical Co.

(e) 5.0% of a brightstock lubricity agent;

(f) 50.0% mineral lubricating oil.

Three combustion improver additives were prepared identified as A, B and C below. Each was the reaction product of a 50%/50% by weight mixture of a borated polyisobutenyl ($\overline{M}n$ 950) succinimide dispersant containing 1.3 wt. % boron with:

A: an acid phosphate amine salt formed by first reacting a dialkyldithiophosphoric acid made from methylisobutyl carbinol with propylene oxide and $P_2O_5$ and partially neutralizing it with a $C_{12}/C_{14}$ t-alkyl primary amine; the amine salt is provided as a 75% by weight solution in mineral oil;

B: a 74% by weight solution in mineral oil of a ZDDP prepared from $P_2S_5$, 2-methyl-1-propanol, pentan-1-ol and 2-methyl-butanol;

C: an 80% solution in kerosene of an amine salt of mixed acid alkyl phosphates.

A sample of the test oil above containing 1.48 wt. % of Additive B was subjected to a laboratory oil burning test, the procedure for which is as follows:

A one gallon can cap, if previously used, was cleaned using steel wool and powdered cleanser, dried with a paper towel and scrubbed with an IOSOL 1520 wetted paper towel. It was then heated on the hot plate, cooled in a desiccator and weighed to 4 places. (Note: carbonaceous deposits in the cap grooves were not entirely removed by this procedure. Occasionally any excessive build-up was removed with a steel spatula.)

Seven milliliters of the oil to be evaluated were syringed into the cap. The cap was then centered in the 6 oz. can and the two containers were in turn centered on the reheated hot plate housed in a fume hood.

After two minutes preheat, the oil was ignited with a butane fire starter gun. A second stop watch was started and the fume hood doors closed. The air draft through the fume hood, the relative humidity, lab temperature and atmospheric pressure were recorded.

The time to burn-out was recorded. The can was then removed from the hot plate with tongs and the cap again placed in the desiccator using tweezers. When cool, the cap was re-weighed and the residue/100 ml of oil calculated.

The results are in Table 1.

Table 2 shows the results for Additives A, B and C when added to "Motomaster Premium Outboard Motor Oil", a two cycle oil commercially available from Canadian Tire Corp. and comparison was made with "Molyvan-L", a known combustion improver. Table 2 shows that Additives A, B and C exhibit satisfactory performance.

TABLE 1

Burning Test Results for Additive B in Test Oil

| Test No. | Treat, Wt. % | Burn Time Min:sec | Total Residue g/100 ml oil |
|---|---|---|---|
| 1 | None | 8:14 | 5.71 |
| 2 | 1.48 | 9:00 | 4.68 |
| 3 | 1.48 | 8:56 | 4.61 |

TABLE 2

Burning Test Results for Combustion Improvers Added to "Motomaster Premium"

| Test No. | Additive | Treat, Wt. % | Burn Time Min:sec | Total Residue g/100 ml oil |
|---|---|---|---|---|
| 1 | None | — | 8:19 | 7.03 |
| 2 | Molyvan-L[(1)] | 1.09 | 7:57 | 4.72 |
| 3 | A | 1.09 | 8:03 | 6.76 |
| 4 | A | 2.15 | 7:48 | 6.12 |
| 5 | B | 1.09 | 8:47 | 4.92 |
| 6 | B | 2.15 | 8:55 | 4.24 |
| 7 | C | 2.15 | 8:06 | 5.92 |

[(1)]A known combustion improver in our burning test: sulphurized oxy molybdenum dialkyl-dithiophosphate.

What is claimed is:

1. A two-cycle lubricating oil composition having a kinematic viscosity of at least 6.5 $mm_2/s$ (cSt) at 100° C. which comprises an admixture of:

(a) 3–50 wt. % of a polybutene polymer having a $\overline{M}n$ of about 300–1500;

(b) 2–45 wt. % of a normally liquid aliphatic hydrocarbon solvent having a boiling point of up to 380° C.;

(c) 0.1 to 10.0% by weight of a combustion improving additive being the reaction product of (1) a borated nitrogen-containing lubricating oil dispersant, and (2) a phosphorus compound selected from the group consisting of (i) zinc dialkyldithiophosphates, and (ii) amine salts of acid phosphates of the formula $(RX)_2P(:X)XH$ where R is H or $C_3$–$C_{20}$ hydrocarbyl, at least one R being hydrocarbyl, and X may be O or S, wherein the amine is a primary or secondary $C_3$–$C_{20}$ aliphatic or aromatic amine;

(d) 20 to 94.9% by weight of a mineral or synthetic oil of lubricating viscosity; and (e) 0 to 20% by weight of an additive package for two cycle lubricating oil additives, such additives being present in an amount to provide their normal attendant functions and enable the two-cycle lubricating oil composition to satisfy the industry standards for two cycle lubricating oil compositions.

2. The composition of claim 1 wherein the combustion improving additive is the reaction product of a borated polyisobutenyl ($\overline{M}n$ 450–2,500) succinimide dispersant.

3. The composition of claim 1 wherein the combustion improving additive is the reaction product of a zinc dialkyldithiophosphate.

4. The composition of claim 1 wherein the (a) ingredient has a Mn of 400–1,300.

5. The composition of claim 1 wherein there is present 0.5–7.0 wt. % of the (e) ingredient.

6. A combustion improving additive being the reaction product of (1) a borated nitrogen-containing lubricating oil dispersant, and (2) a phosphorus compound selected from the group consisting of (i) zinc dialkyldithiophosphates, and (ii) amine salts of acid phosphates of the formula $(RX)_2P(:X)XH$ where R is H or $C_3$–$C_{20}$ hydrocarbyl, at least one R being hydrocarbyl, and X may be O or S, wherein the amine is a primary or secondary $C_3$–$C_{20}$ aliphatic or aromatic amine.

7. The additive of claim 6 wherein the dispersant is a borated polyisobutenyl succinimide dispersant wherein the polyisobutenyl has a Mn 450–2,500.

8. The additive of claim 6 wherein the dispersant contains 0.1 to 5.0 wt. % boron.

9. The additive of claim 6 wherein the phosphorus compound is a zinc dialkyldithiophosphate.

10. The additive of claim 9 wherein the zinc dialkyldithiophosphate is prepared from $C_4$–$C_8$ aliphatic alcohols.

11. A lubricating oil composition suitable for lubrication of both two-cycle engines and small four-cycle engines of 3–25 horsepower having a kinematic viscosity of at least 6.5 $mm_2/s$ (cSt) at 100° C. which comprises an admixture of:

(a) 3–50 wt. % of a polybutene polymer having a Mn of about 300–1500;

(b) 2–15 wt. % of a normally liquid aliphatic hydrocarbon solvent having a boiling point of up to 380° C.;

(c) 0.1 to 10% by weight of a combustion improving additive being the reaction product of (1) a borated nitrogen-containing lubricating oil dispersant, and (2) a phosphorus compound selected from the group consisting of (i) zinc dialkyldithiophosphates, and (ii) amine salts of acid phosphates of the formula $(RX)_2P(:X)XH$ where R is H or $C_3$–$C_{20}$ hydrocarbyl, at least one R being hydrocarbyl, and X may be O or S, wherein the amine is a primary or secondary $C_3$–$C_{20}$ aliphatic or aromatic amine;

(d) 20 to 94.9% by weight of a mineral or synthetic oil of lubricating viscosity; and (e) 0 to 20% by weight of an additive package for two cycle lubricating oil additives, such additives being present in an amount to provide their normal attendant functions and enable the two-cycle lubricating oil composition to satisfy the industry standards for two cycle lubricating oil compositions.

12. The composition of claim 11 wherein the combustion improving additive is the reaction product of borated polyisobutenyl (Mn 450–2500) succinimide dispersant.

13. The composition of claim 11 wherein the phosphorus compound is zinc dialkyldithiophosphate.

14. A lubricating oil composition comprising an oil of lubricating viscosity and the combustion improving additive of claim 6.

* * * * *